US007808471B2

(12) United States Patent
Shin

(10) Patent No.: US 7,808,471 B2
(45) Date of Patent: Oct. 5, 2010

(54) SCAN DRIVING CIRCUIT AND ORGANIC LIGHT EMITTING DISPLAY USING THE SAME

(75) Inventor: Dong Yong Shin, Seoul (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 970 days.

(21) Appl. No.: 11/528,669

(22) Filed: Sep. 28, 2006

(65) Prior Publication Data

US 2007/0089000 A1 Apr. 19, 2007

(30) Foreign Application Priority Data

Sep. 30, 2005 (KR) ..... 10-2005-0092316

(51) Int. Cl.
*G09G 3/36* (2006.01)

(52) U.S. Cl. ..... 345/100; 377/64

(58) Field of Classification Search ..... 345/76–83, 345/98–100, 690, 82; 377/64–81; 315/160–176; 313/361
See application file for complete search history.

(56) References Cited

U.S. PATENT DOCUMENTS 6,339,631 B1 * 1/2002 Yeo et al. ..... 377/64
7,098,882 B2 8/2006 Kitani et al.
2001/0022573 A1 * 9/2001 Sasaki et al. ..... 345/100
2002/0130685 A1 * 9/2002 Forbes ..... 326/98
2002/0149318 A1 * 10/2002 Jeon et al. ..... 315/169.1
2004/0218710 A1 * 11/2004 Shih et al. ..... 377/64
2005/0057553 A1 * 3/2005 Shih et al. ..... 345/211
2005/0140602 A1 * 6/2005 Shin et al. ..... 345/76
2006/0145964 A1 * 7/2006 Park et al. ..... 345/76

FOREIGN PATENT DOCUMENTS

JP 05-019714 1/1993
JP 2000-347628 12/2000
JP 2001-273785 A 10/2001
JP 2002-049360 2/2002
JP 2004-185684 A 7/2004

* cited by examiner

*Primary Examiner*—Alexander Eisen
*Assistant Examiner*—Patrick Marinelli
(74) *Attorney, Agent, or Firm*—Lee & Morse, P.C.

(57) ABSTRACT

A scan driving circuit including an input terminal to receive an input signal or a voltage output from a previous stage; first and second clock terminals to receive first and second clock signals having phases inverted to each other and partially overlap at a high level, respectively; and a plurality of stages having an output terminal to output scan signals having a low level in sequence, leaving an interval between the scan signals, equivalent to a time the first and second clock signals overlap at the high level, wherein the output terminal of the stage is maintained to have a non-floating state regardless of whether the stage outputs the scan signal.

22 Claims, 8 Drawing Sheets

SCAN DRIVING CIRCUIT AND ORGANIC LIGHT EMITTING DISPLAY USING THE SAME

BACKGROUND OF THE INVENTION

1. Field of the Invention

The present invention relates to a driving circuit for an active matrix. More particularly, the present invention relates to a scan driving circuit to drive a pixel line of an organic light emitting display.

2. Description of the Related Art

Various flat panel displays have recently been developed as alternatives to a relatively heavy and bulky cathode ray tube (CRT) display. The flat panel display includes a liquid crystal display (LCD), a field emission display (FED), a plasma display panel (PDP), and an organic light emitting display (OLED).

Among the flat panel displays, the OLED employs an emission device emitting light by recombination of an electron and a hole for displaying an image. Such an organic light emitting display has advantages of short response time and low power consumption.

FIG. 1 illustrates a schematic of a conventional OLED.

Referring to FIG. 1, the conventional organic light emitting display may include a pixel portion 30 having a plurality of pixels 40 connected to a plurality of scan lines S1 through Sn and a plurality of data lines D1 through Dm, a scan driving circuit 10 to drive the plurality of scan lines S1 through Sn, a data driver 20 to drive the plurality of data lines D1 through Dm, and a timing controller 50 to control the scan driving circuit 10 and the data driver 20.

The scan lines S1 through Sn and the data lines D1 through Dm may be formed within the pixel portion 30, and may intersect each other, forming a matrix.

The timing controller 50 may generate a data control signal DCS and a scan control signal SCS in response to external synchronous signals. The timing controller 50 may supply the data control signal to the data driver 20 and the scan control signal SCS to the scan driving circuit 10. The timing controller 50 may also supply DATA to the data driver 20.

The scan driving circuit 10 may receive the scan control signal SCS from the timing controller 50. The scan driver 10 may generate a scan signal based on the scan control signal SCS and may supply the scan signals to the scan lines S1 through Sn in sequence.

The data driver 20 may receive the data control signal DCS from the timing controller 50. The data driver 20 may generate a data signal based on the data control signal DCS and may supply the data signals to the data lines D1 through Dn while synchronizing with the scan signals.

The pixel portion 30 may receive a first power source voltage ELVDD and a second power source voltage ELVSS and may apply them to the respective pixels 40. Each of pixels 40 may receive the first and second power source voltages ELVDD and ELVSS and may control a current flowing from the first power source voltage ELVDD to the second power source voltage ELVSS via the emission device on the basis of the data signal, thereby emitting light corresponding to the data signal.

In the OLED with the foregoing configuration, coupling capacitance may arise at the intersections between scan lines and the data lines. Therefore, the scan signals sequentially supplied from the scan driving circuit 10 to the scan lines S1 through Sn may be changed by the coupling capacitance due to the data lines intersecting the scan lines.

SUMMARY OF THE INVENTION

The present invention is therefore directed to prevent the scan signal from varying due to coupling capacitance, which substantially overcomes one or more of the problems due to the limitations and disadvantages of the related art.

Accordingly, it is an aspect of the present invention to provide a scan driving circuit and an organic light emitting display using the same, in which an output terminal of each stage in the scan driving circuit maintains a non-floating state regardless of whether the stage outputs a scan signal or not, thereby preventing the scan signal from varying due to coupling capacitance generated because scan and data lines intersect within a pixel portion.

At least one of the above and other features and advantages of the present invention may be realized by providing a scan driving circuit including: an input terminal to receive an input signal or a voltage output from a previous stage; first and second clock terminals to receive first and second clock signals having phases inverted to each other and partially overlap at a high level, respectively; and a plurality of stages having an output terminal to output scan signals having a low level in sequence and leaving an interval between the scan signals equivalent to the time the first and second clock signals overlap at the high level, wherein the output terminal of the stage is maintained to have a non-floating state regardless of whether the stage outputs the scan signal.

At least one of the above and other features and advantages of the present invention may be realized by providing a scan driving circuit including: a plurality of stages connected to an input signal line or an output voltage line of a previous stage subordinately, and connected to two phase clock signal input lines, including: a first scan driver receiving first and second clock signals and outputting odd numbered scan signals in sequence through the plurality of stages; and a second scan driver receiving third and fourth clock signals and outputting even numbered scan signals in sequence through the plurality of stages, wherein the output terminal of the stage is maintained to have a non-floating state regardless of whether the plurality of stages of the first and second scan drivers outputs the scan signal.

At least one of the above and other features and advantage of the present invention may be realized by providing an organic light emitting display including: a pixel portion having a plurality of pixels connected to scan lines and data lines; a data driving circuit to supply a data signal to the data lines; a scan driving circuit having a plurality of stages connected to an input signal line or an output voltage line of a previous stage subordinately, and connected to two phase clock signal input lines, the scan driving circuit including: a first scan driver receiving first and second clock signals and outputting odd numbered scan signals in sequence through the plurality of stages; and a second scan driver receiving third and fourth clock signals and outputting even numbered scan signals in sequence through the plurality of stages, wherein the output terminal of the stage is maintained to have a non-floating state regardless of whether the plurality of stages of the first and second scan drivers outputs the scan signal.

Each stage may include: a first transistor receiving the voltage output from the previous stage or an initial input signal, and having a gate terminal connected to the first clock terminal; a second transistor having a gate terminal connected to an output terminal of the first transistor, and connected to the second clock terminal and an output line; a third transistor having a gate terminal connected to the first clock terminal, and connected between a second power source and a first node; a fourth transistor having a gate terminal connected to the output terminal of the first transistor, and connected between the first clock terminal and the first node; and a fifth transistor having a gate terminal connected to the first node, and connected between a first power source and the output line.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Korean Patent Application No. 10-2005-0092316, filed on Sep. 30, 2005, in the Korean Intellectual Property Office, and entitled: "Scan Driving Circuit and Organic Light Emitting Display Using the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather these embodiments are provided so that this disclosure will be thorough and complete, and will fully convey the scope of the invention to those skilled in the art.

As will be discussed below, the present invention may provide a scan driving circuit and an organic light emitting display using the same that prevents the scan signal from varying due to coupling capacitance generated at the intersection of the scan lines and the data lines within a pixel portion.

Figure 1:
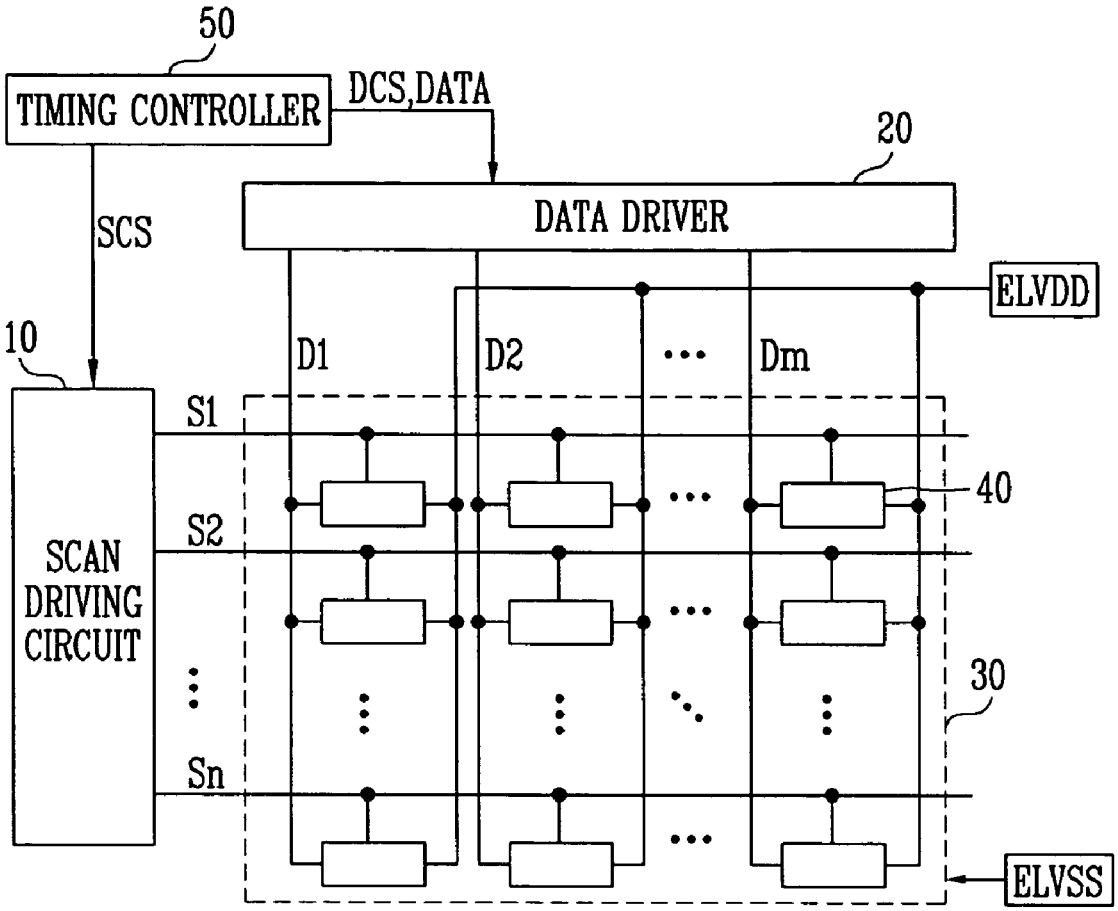
FIG. 1 (RELATED ART)
FIG. 1 illustrates a schematic of a conventional organic light emitting display.
Figure 2:
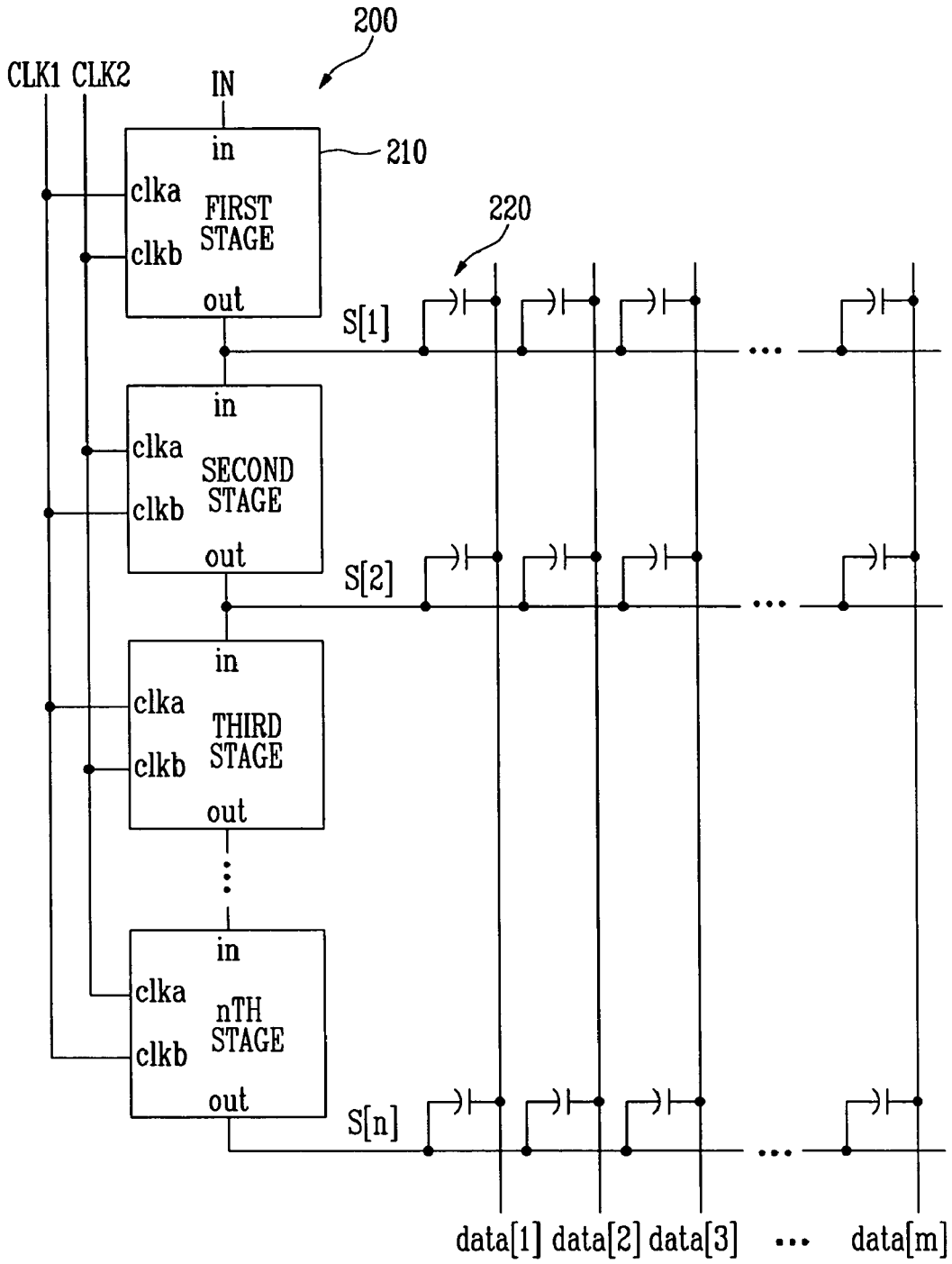
FIG. 2 illustrates a schematic of a scan driving circuit according to a first exemplary embodiment of the present invention.

FIG. 2 illustrates a schematic of a scan driving circuit according to a first exemplary embodiment of the present invention. Referring to FIG. 2, a scan driving circuit 200 may include n stages 210 subordinately connected to a line for an input signal IN, thereby outputting scan signals in sequence to drive a plurality of pixels provided in a pixel portion.

Output lines of n stages 210 may be connected to scan lines S1 through Sn within the pixel portion, respectively. Thus, the scan signal may be supplied to each pixel forming the pixel portion.

In the scan driving circuit 200, a $1^{st}$ stage may receive an initial input signal IN and the output signals of the $1^{st}$ through $(n-1)^{th}$ stages may be supplied as input signals to the following stages thereof, respectively.

Each stage of the scan driving circuit 200 outputting the scan signal may include a first clock terminal CLKa and a second clock terminal CLKb, which receive first and second clock signals CLK1 and CLK2 that have phases inverted to each other and partially overlap at a high level. In the odd numbered stages, the first clock terminals CLKa may receive the first clock signal CLK1, and the second clock terminals CLKb may receive the second clock signal 2. In the even numbered stages, the first clock terminals CLKa may receive the second clock signal CLK2, and the second clock terminals CLKb may receive the first clock signal CLK1.

That is, the stages, which receive the initial input signal IN or the output voltages from the previous terminals and the first and second clock signals CLK1 and CLK2, output low level signals through the respective output lines thereof in sequence, leaving an interval between the low level signals equivalent to the time the first and second clock signals overlap at the high level.

Further, as shown in FIG. 2, n scan lines S[1] through S[n] sequentially receiving the scan signals from the scan driving circuit 200 may intersect m data lines data[1] through data[m] in the pixel portion. Here, coupling capacitor 220 may be formed in a region where the scan lines and the data lines intersect.

The conventional organic light emitting display has a problem that the coupling capacitor 220 may change the scan signal. However, the scan driving circuit according to an exemplary embodiment of the present invention requires the output terminal of the stage to maintain a non-floating state regardless of whether the stage outputs the scan signal, thereby preventing the scan signal applied to each scan line from varying due to the capacitance of the coupling capacitor 220.

Figure 3:
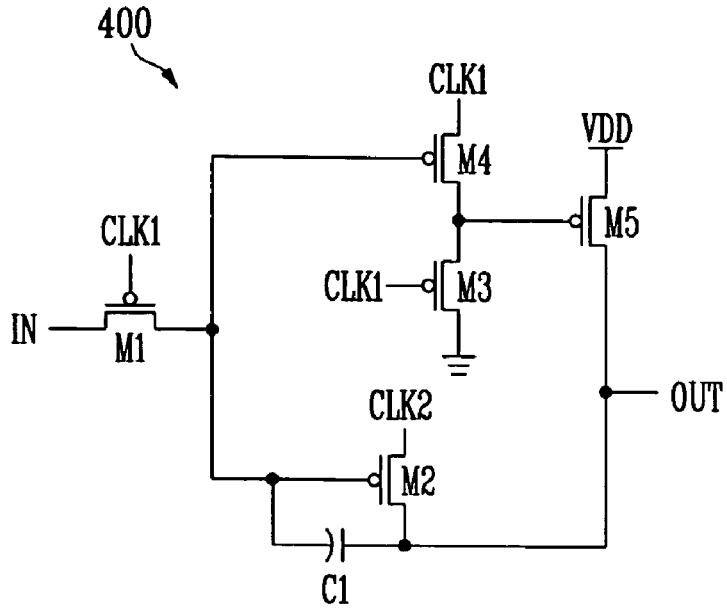
FIG. 3 illustrates a circuit diagram of a stage in the scan driving circuit according to the first exemplary embodiment of the present invention.
Figure 4:
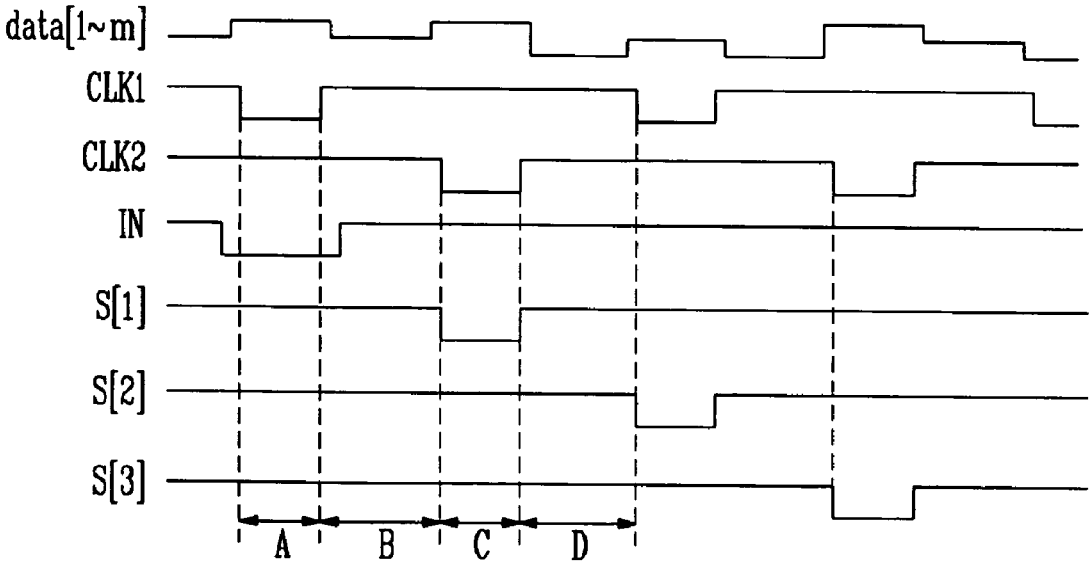
FIG. 4 illustrates a timing diagram of input/output signals of the stage of FIG. 3.

FIG. 3 illustrates a circuit diagram of an odd-numbered stage in the scan driving circuit according to the first exemplary embodiment of the present invention. FIG. 4 illustrates a timing diagram of input/output signals of the stage of FIG. 3.

Referring to FIGS. 3 and 4, the odd numbered stage of the scan driving circuit may perform pre-charge in a first period A during which the clock signals CLK1 and CLK2 are out of phase with each other, and may perform evaluation in a third period C. During the third period C, the clock signals have an inverse phase compared to that of the first period A, thereby outputting low level pulses in sequence and leaving an interval equivalent to the time the clock signals overlap at the high level. That is, the high level signal is output in the pre-charge period and the signal corresponding to the input of the pre-charge period is output in the evaluation period.

The evaluation period for the odd numbered stage may be equal to the pre-charge period for even numbered stages.

In second period B and fourth period D, where both the clock signals are at the high level, a pull-up or pull-down switch of the stage may also be turned on, so that the output terminal of the stage maintains the non-floating state in the first through fourth periods. Thus, the output terminal of the stage maintains the non-floating state regardless of the output of the scan signal, so that the scan signal applied to each scan line is prevented from varying due to the coupling capacitance generated at the intersection of the scan lines and the data lines.

Below, a detailed operation of the stage will be described with reference to the circuit configuration of the odd numbered stage illustrated in FIG. 3. Hereinafter, the stage uses a positive metal oxide silicon thin film transistor (PMOS TFT) by way of example, but is not limited thereto.

Referring to FIG. 3, an odd numbered stage 400 according to the first exemplary embodiment of the present invention may include a first transistor M1 receiving a previous output voltage gi or an initial input signal IN and having a gate terminal connected to a first clock terminal; a second transistor M2 having a gate terminal connected to an output terminal of the first transistor M1 and connected to a second clock terminal and an output line OUT; a third transistor M3 having a gate terminal connected to the first clock terminal and connected between the second power source VSS and a first node N1; a fourth transistor M4 having a gate terminal connected to the output terminal of the first Transistor M1 and connected between the first clock terminal and the first node N1; and a fifth transistor M5 having a gate terminal connected to the first node N1 and connected between the first power source VDD and the output line OUT. The odd numbered stage 400 may also include a first capacitor C1 connected between the output terminal of the first Transistor M1 and the output line OUT.

Because the foregoing stage is the odd numbered stage of the scan driving circuit, the first clock signal CLK1 is supplied to the first clock terminal and the second clock signal CLK2 is supplied to the second clock terminal. For an even numbered stage, the second clock signal CLK2 is supplied to the first clock terminal and the first clock signal CLK1 is supplied to the second clock terminal.

In this exemplary embodiment, the second power source VSS is implemented by a ground GND as shown in FIG. 3, but is not limited thereto. Alternatively, a separate negative power source can be applied as the second power source VSS.

Each stage may include a transfer unit, an inversion unit and a buffer unit. The first and second transistors M1 and M2 and the first capacitor C1 may serve as the transfer unit. The first, third and fourth transistors M1, M3 and M4 may serve as the inversion unit. The fifth transistor M5 may serve as the buffer unit.

As illustrated therein, the stage is in the pre-charge period (the first period A) when the first clock signal CLK1 has the low level, i.e., the second clock signal CLK2 has the high level. The stage is in the evaluation period (the third period C) when the first clock signal CLK1 has the high level, i.e., the second clock signal CLK2 has the low level. Therefore, the stage outputs a high level signal in the pre-charge period and outputs the signal corresponding to the input of the pre-charge period in the evaluation period.

During the second period B and the fourth period D, the first and second clock signals partially overlap at the high level. In the second and fourth periods, the pull-up or pull-down switches forming the stage may be turned on, so that the output terminal of the stage maintains the non-floating state during the first through fourth stages.

Thus, the output terminal of the stage connected to the scan line maintains the non-floating state regardless of the output of the scan signal, so that the scan signal applied to each scan line is prevented from varying due to the coupling capacitance generated at the intersection of the scan lines and the data lines.

Further, the stage may output the low level signals in sequence, leaving an interval as much as an overlap of the pair of clock signals CLK1 and CLK2 are input to each stage during the second and fourth periods. Therefore, a predetermined interval is left between the output signals of each stage, thereby securing a margin of a clock skew or a clock delay.

Referring to FIGS. 3 and 4, the odd numbered stage may operate as follows. The first and third transistors M1 and M3 may be turned on in the pre-charge period, i.e., in the first period A during which the first clock signal CLK1 and the second clock signal CLK2 are input as the low level and the high level, respectively. Then, the input signal IN may be transmitted to each gate terminal of the second and fourth transistors M2 and M4.

Therefore, in the pre-charge period, the previous output voltage or the input signal IN may be stored as the input signal in the first capacitor C1. Further, the first node N1 may be charged with the low level signal by the first clock signal CLK1 or the second power source VSS, so that the fifth transistor M5 is turned on, thereby outputting the first power source VDD having the high level through the output terminal OUT. That is, in the pre-charge period, the buffer unit of the stage may output the high level signal. Hence, the fifth transistor M5 may be turned on in the first period A and the second transistor M2 may pull-up on or off according to the signal IN or gi, so that the output terminal OUT is in the non-floating state.

Further, the first transistor M1 may be turned off in the evaluation period, i.e., the third period C during which the first and second clock signal CLK1 and CLK2 are input as the high level and the low level, respectively, so that the input signal IN is intercepted, thereby turning off the third and fourth transistors M3 and M4.

When the signal (i.e., the previous output voltage or the input signal IN) received in the pre-charge period has the high level, the level of the signal pre-charged in the pre-charge period may be maintained, so that the buffer unit still outputs the high level. That is, the fifth transistor M5 continues to be turned on, so that the first power source VDD having the high level is output through the output terminal OUT. Further, the second transistor M2 is turned off by the high level signal stored in the first capacitor C1 in the pre-charge period.

When the signal (i.e., the previous output voltage or the input signal IN) received in the pre-charge period has the low level, the second transistor M2 is turned on by the low level signal stored in the first capacitor C1 in the pre-charge period. Further, the fourth transistor M4 is turned on by the low level signal stored in the first capacitor C1, so that the first clock signal CLK1 is input to the gate terminal of the fifth transistor M5, thereby turning off the fifth transistor M5. As the second transistor M2 is turned on and the fifth transistor M5 is turned off, the second clock signal CLK2 having the low level is output through the output terminal OUT. Hence, the output terminal OUT is in the non-floating state whether the fifth transistor M5 and the second transistor M2 are either turned on and off or off and on, respectively.

In the evaluation period, the stage may output the low level when the previous output voltage or the initial input signal IN received in the previous pre-charge period, i.e., the first period A, has the low level. On the other hand, the stage may output the high level when the previous output voltage or the initial input signal IN received in the previous pre-charge period, i.e., the first period A, has the high level.

Meanwhile, as discussed above, the first and second clock signals input to the stage may partially overlap at the high level as shown in FIG. 4.

Therefore, in the case where the first and second clock signals CLK1 and CLK2 are at the high level, when the previous period is the pre-charge period, i.e, the second period B, the first and third transistors M1 and M3 to be controlled by the first clock signal CLK1 are all turned off, and the voltage of the capacitor C1 is maintained, thereby maintaining the previous output.

In the fourth period D, the output terminal OUT is in the non-floating state whether the fifth transistor M5 and the second transistor M2 are either turned on and off or off and on, respectively, like the third period C.

Hence, the stage may maintain the output terminal OUT thereof to be in the non-floating state during the first through fourth periods A through D. Therefore, as discussed above, the scan signal applied to each scan line may be prevented from varying due to the coupling capacitance formed at the intersection of the scan lines and the data lines.

When the first and second clock signals, CLK1 and CLK2, are at the high level, when the previous period is the pre-charge period, the previous output is maintained. When the previous period is the evaluation period, the output becomes the high level. Therefore, an interval between the output pulses of neighboring stages is reduced, which may be equivalent to the time the first and second clock signals CLK1 and CLK2 overlap at the high level, thereby securing the margin of the clock skew or the clock delay.

Figure 5:
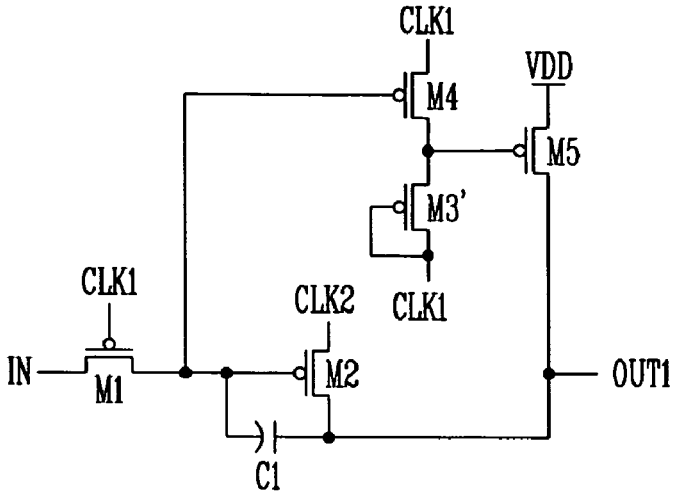
FIG. 5 illustrates a circuit diagram of an odd numbered stage of a scan driving circuit according to a second exemplary embodiment of the present invention.

FIG. 5 illustrates a circuit diagram of an odd numbered stage of a scan driving circuit according to a second exemplary embodiment of the present invention. As compared with the first exemplary embodiment shown in FIG. 3, like numerals refer to like elements, and repetitive descriptions will not be discussed.

In a third transistor M3' according to the second exemplary embodiment as compared with the third transistor M3 of the odd numbered stage according to the first exemplary embodiment, a first clock terminal is connected in common to a gate terminal and an output terminal of the third transistor M3.

In more detail, the third transistor M3 according to the first exemplary embodiment has the gate terminal connected to the first clock terminal and is connected between the ground power source VSS and the first node N1. However, the third transistor M3' according to the second exemplary embodiment has the gate terminal and the output terminal connected in common to the first clock terminal, and an input terminal connected to the first node N1. The third transistor M3' according to the second exemplary embodiment of the present invention operates as described above, so repetitive descriptions will not be discussed.

Figure 6:
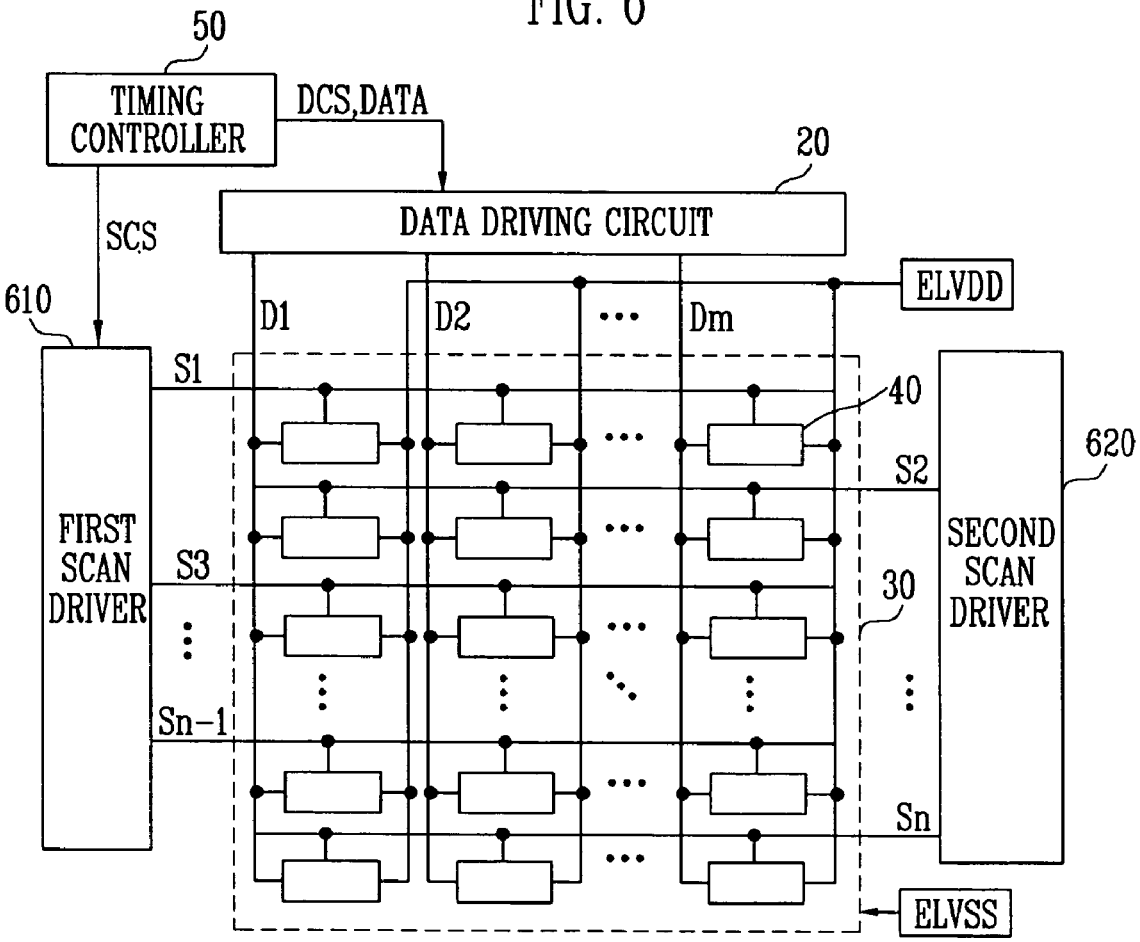
FIG. 6 illustrates a schematic of an organic light emitting display according to another exemplary embodiment of the present invention.

FIG. 6 illustrates a schematic view of an organic light emitting display according to another exemplary embodiment of the present invention.

Referring to FIG. 6, the organic light emitting display according to another exemplary embodiment of the present invention may include the pixel portion 30 having the plurality of pixels 40 connected to scan lines S1 through Sn and data lines D1 through Dm; a scan driving circuit including a first scan driver 610 and a second scan driver 620 to drive the scan lines S1 through Sn; the data driving circuit 20 to drive the data lines D1 through Dm; and the timing controller 50 to control the scan drivers 610, 620 and the data driving circuit 20. Here, the first scan driver 610 to may supply scan signals in sequence to odd numbered scan lines, and the second scan driver 620 may supply the scan signals in sequence to even numbered scan lines. The scan lines S1 through Sn and the data lines D1 through Dm intersect within the pixel portion 30.

The timing controller 50 may generate the data control signal DCS and the scan control signal SCS in response to synchronous signals supplied from an external source. The data controls signal DCS may be supplied to the data driving circuit 20 and the scan control signal SCS may be supplied to the scan driving circuit. Further, the timing controller 50 may supply DATA from an external source to the data driving circuit 20.

The first and second scan drivers 610 and 620 of the scan driving circuit may receive the scan control signals SCS from the timing controller 50. The first and second scan drivers 610 and 620 may receive the scan control signals SCS and generate an odd numbered scan signal and an even numbered scan signal, respectively, thereby supplying the scan signals to the scan lines S1 through Sn, in sequence.

The data driving circuit 20 may receive the data control signal DCS from the timing controller 50. The data driving circuit 20 may receive the data control signal DCS and may generate the data signal, thereby supplying the data signals to the data lines D1 through Dm in sequence to be synchronized with the scan signals.

The pixel portion 30 receives a first power source voltage ELVDD and a second power source voltage ELVSS and may apply them to the respective pixels 40. Each of pixels 40 may receive the first and second power source voltages ELVDD and ELVSS and may control a current flowing from the first power source voltage ELVDD to the second power source voltage ELVSS via an emission device on the basis of the data signal, thereby emitting light corresponding to the data signal.

Figure 7:
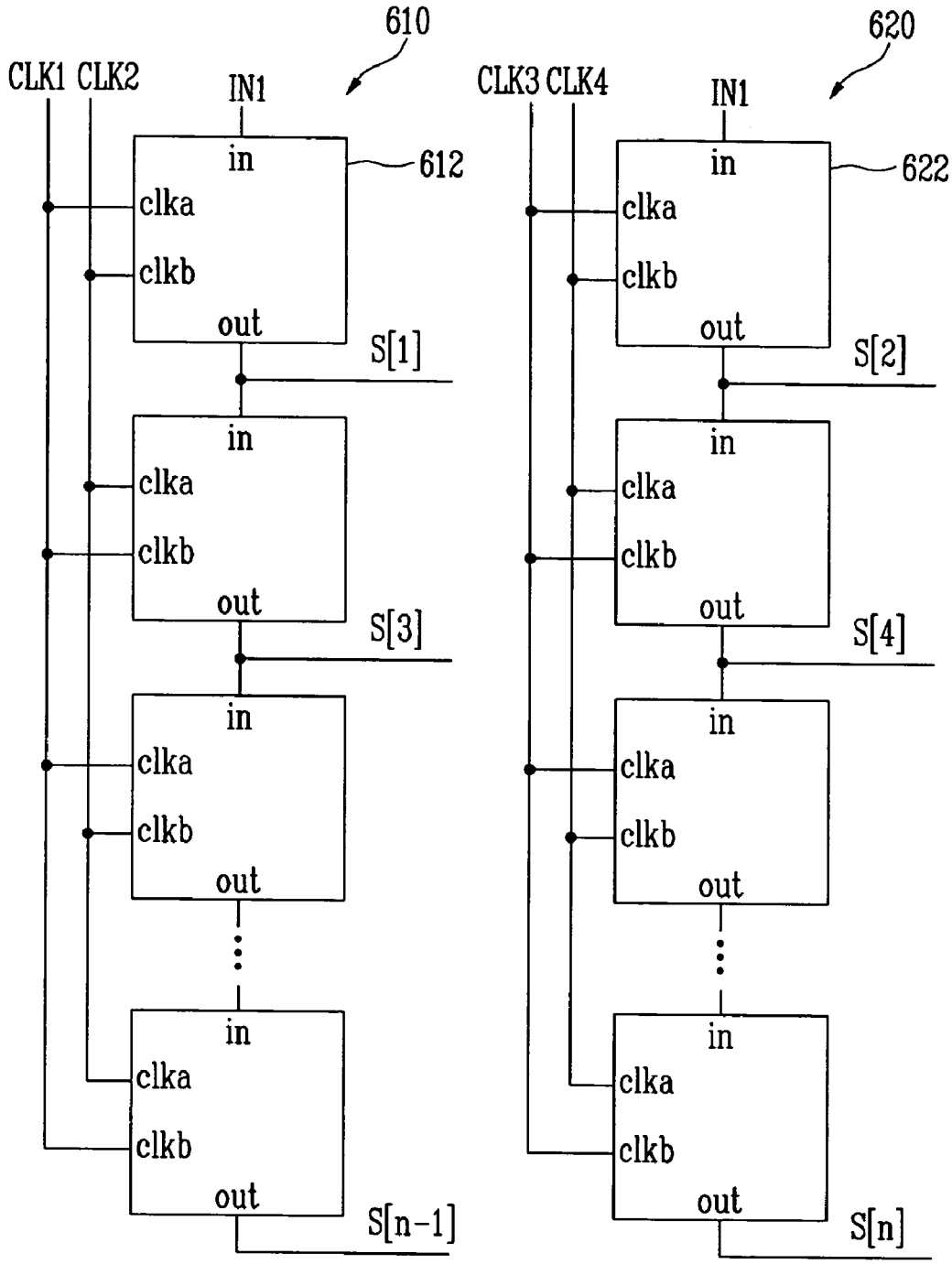
FIG. 7 illustrates a schematic of the scan driving circuit according to the second exemplary embodiment of the present invention.

FIG. 7 illustrates a schematic of the scan driving circuit according to the second exemplary embodiment of the present invention, which is provided in the organic light emitting display of FIG. 6.

Referring to FIG. 7, the scan driving circuit according to the second exemplary embodiment may include the first and second scan drivers 610 and 620 generating the odd numbered scan signals and the even numbered scan signals, respectively, and supplying them to the scan lines S1 though Sn so as to drive the plurality of pixels provided in the pixel portion. Each of the first and second scan drivers 610 and 620 may include a plurality of stages connected to input lines IN1 and IN2, respectively.

In the first scan driver 610 and the second scan driver 620, a $1^{st}$ stage receives initial input signals IN1 and IN2, and the output signals of the $1^{st}$ stage through the $(n-1)^{th}$ stages may be supplied as input signals to the following stages, respectively.

Further, each stage may include the first clock terminal CLKa and the second clock terminal CLKb which receive first and second clock signals CLK1 and CLK2 or third and fourth clock signals CLK3 and CLK4, having inverted phases and partially overlap at a high level.

In the odd numbered stages of the first scan driver 610, the first clock terminals CLKa may receive a first clock signal CLK1 and the second clock terminals CLKb may receive a second clock signal CLK2. In the even numbered stages, the first clock terminals CLKa may receive the second clock signal CLK2 and the second clock terminals CLKb may receive the first clock signal CLK1.

In the odd numbered stages of the second scan driver 620, the first clock terminals CLKa may receive a third clock signal CLK3 and the second clock terminals CLKb may receive a fourth clock signal CLK4. In the even numbered stages, the first clock terminals CLKa may receive a fourth clock signal CLK4 and the second clock terminals CLb may receive the third signal CLK3.

That is, the stages, which receive the initial input signals IN1 and IN2, the output voltages from the previous terminals, and the first and second clock signals CLK1 and CLK2 or the third and fourth clock signals CLK3 and CLK4, output low level signals through the respective output lines thereof in sequence, leaving an interval between the low level signals. The interval is equivalent to the time the first and second clock signals overlap at the high level or the third and fourth clock signals overlap at the high level.

Stages 612 and 622 of the first scan driver 610 and the second scan driver 620 may have the same configuration as those illustrated in FIGS. 3 and 5. Therefore, each stage of the first and second scan drivers maintains the output terminal thereof to be in the non-floating state in the first through fourth periods A through D, thereby preventing the scan signal applied to each scan line from varying due to the coupling capacitance formed because the scan lines intersect the data lines within the pixel portion.

The scan driving circuit may be divided into the first scan driver 610 and the second scan driver 620, and the scan signal may be outputted by a progressive scan method or an interlaced scan method.

Figure 8:
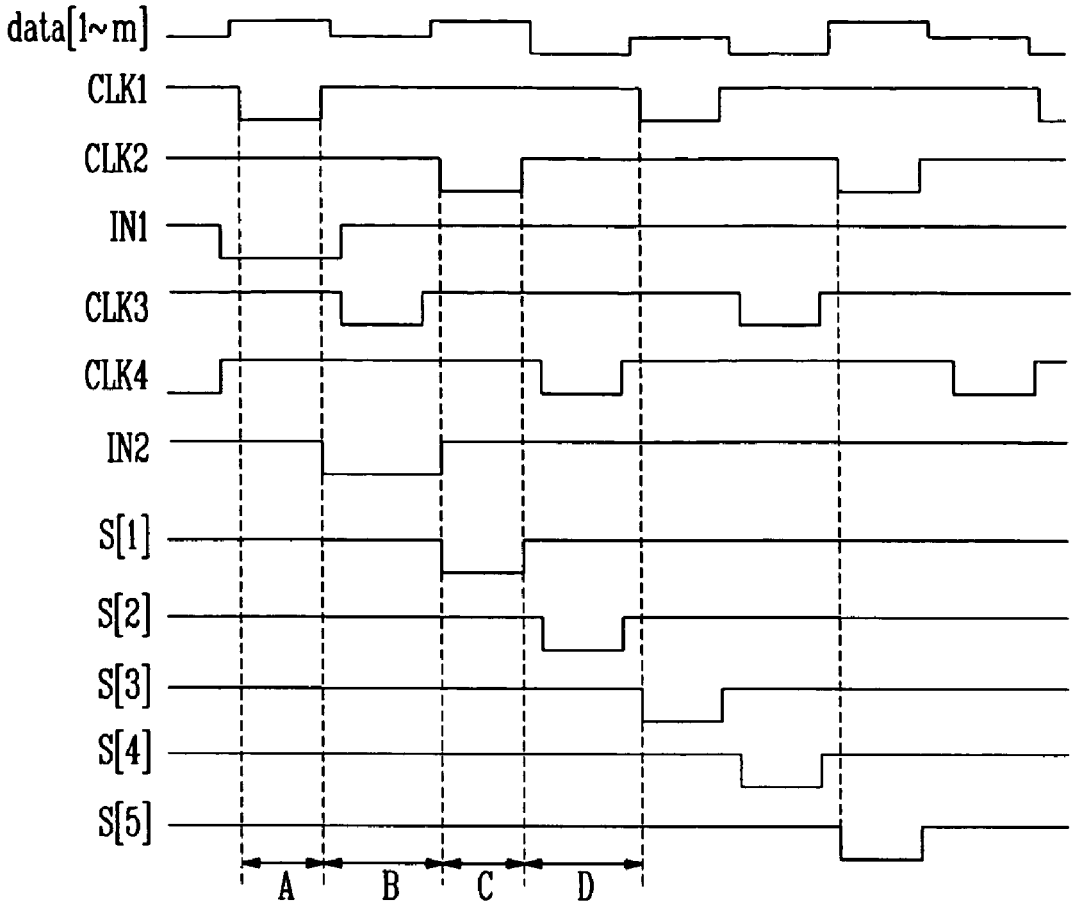
FIG. 8 illustrates a timing diagram of input/output signals of the stage in the scan driving circuit that is driven by a progressive scanning method, according to an exemplary embodiment of the present invention.

FIG. 8 illustrates a timing diagram of input/output signals of the stage in the scan driving circuit driven by a progressive scanning method, according to an exemplary embodiment of the present invention. In this exemplary embodiment, the stage may be the same configuration as those shown in FIGS. 3 and 5, and thus repetitive descriptions will not be discussed.

Referring to FIGS. 3, 7 and 8, the first scan driver may receive the input signal IN1 and the first and second clock signals CLK1 and CLK2, and may output the odd numbered scan signals S[1], S[3], . . . in sequence, and the second scan driver may receive the input signal IN2 and the third and fourth clock signals CLK3 and CLK4, and may outputs the even numbered scan signals S[2], S[4], . . . in sequence. The odd numbered scan signal and the even numbered scan signal may be alternately output from the first scan driver and the second scan driver, respectively. Therefore, the odd numbered scan signal and the even numbered scan signal may be supplied to the pixel portion in sequence, as can be seen in FIG. 8.

Here, the first and second clock signals have phases inverted to each other and partially overlap at the high level. Likewise, the third and fourth clock signals have phases inverted to each other and partially overlap at the high level. The third and fourth clock signals may be in the low level while the first and second clock signals partially overlap at the high level.

In the scan driving circuit with this configuration, the stages of the first scan driver and the second scan driver may maintain the output terminals OUT thereof to be in the non-floating state (in the case of the first scan driver, during the first period A through the fourth period D) as described above referring to FIGS. 3 and 4. Likewise, the second scan driver may maintain the non-floating state of the output terminal OUT.

Therefore, the scan signal may be prevented from varying due to the coupling capacitance formed at the intersection between the scan lines and the data lines.

Figure 9:
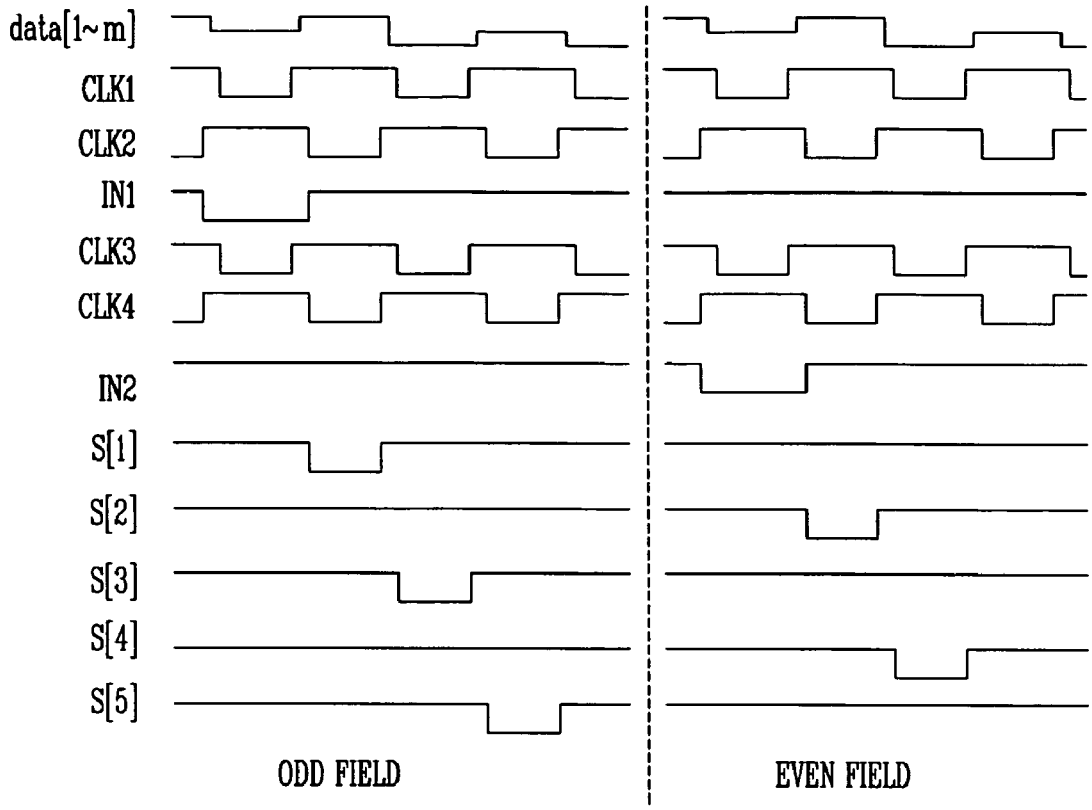
FIG. 9 illustrates a timing diagram of input/output signals of the stage in the scan driving circuit that is driven by an interlaced scanning method, according to an exemplary embodiment of the present invention.

FIG. 9 illustrates a timing diagram of input/output signals of the stage in the scan driving circuit driven by an interlaced scanning method, according to an exemplary embodiment of the present invention. In this exemplary embodiment, the stage may have the same configuration as those illustrated in FIGS. 3 and 5, so repetitive descriptions will not be discussed.

Referring to FIGS. 3, 7 and 9, the first scan driver may receive the input signal IN1 and the first and second clock signals CLK1 and CLK2, and may output the odd numbered scan signals S[1], S[3], . . . in sequence, and the second scan driver may receive the input signal IN2 and the third and fourth clock signals CLK3 and CLK4, and may output the even numbered scan signals S[2], S[4], . . . in sequence.

Contrary to the progressive scan method, the odd numbered scan signal and the even numbered scan signal may not alternately output from the first scan driver and the second scan driver, respectively. Rather, the odd numbered scan signal and the even numbered scan signal may be separately supplied to the pixel portion in sequence.

That is, the first scan driver may output the high level signals to the even numbered scan line while outputting the odd numbered scan signals in sequence, so that the pixel connected to the even numbered scan line is not selected. On the other hand, the second scan driver may output the high level signals to the odd numbered scan line while outputting the even numbered scan signals in sequence, so that the pixel connected to the odd numbered scan line is not selected. In other words, the scan signal corresponding to one frame may be divided into the odd numbered scan signal and the even numbered scan signal. Thus, one frame may be divided into an odd field and an even field.

The first and second clock signals have phases inverted to each other and partially overlap at the high level. Likewise, the third and fourth clock signals have phases inverted to each other and partially overlap at the high level. The third and fourth clock signals may have the same waveform as the first and second clock signals.

In the scan driving circuit with this configuration, the stages of the first scan driver and the second scan driver maintain the output terminals OUT thereof to be in the non-floating state during the first period A through the fourth period D as described above referring to FIGS. 3 and 4.

Therefore, the scan signal may be prevented from varying due to the coupling capacitance formed at the intersection between the scan lines and the data lines.

Figure 10:
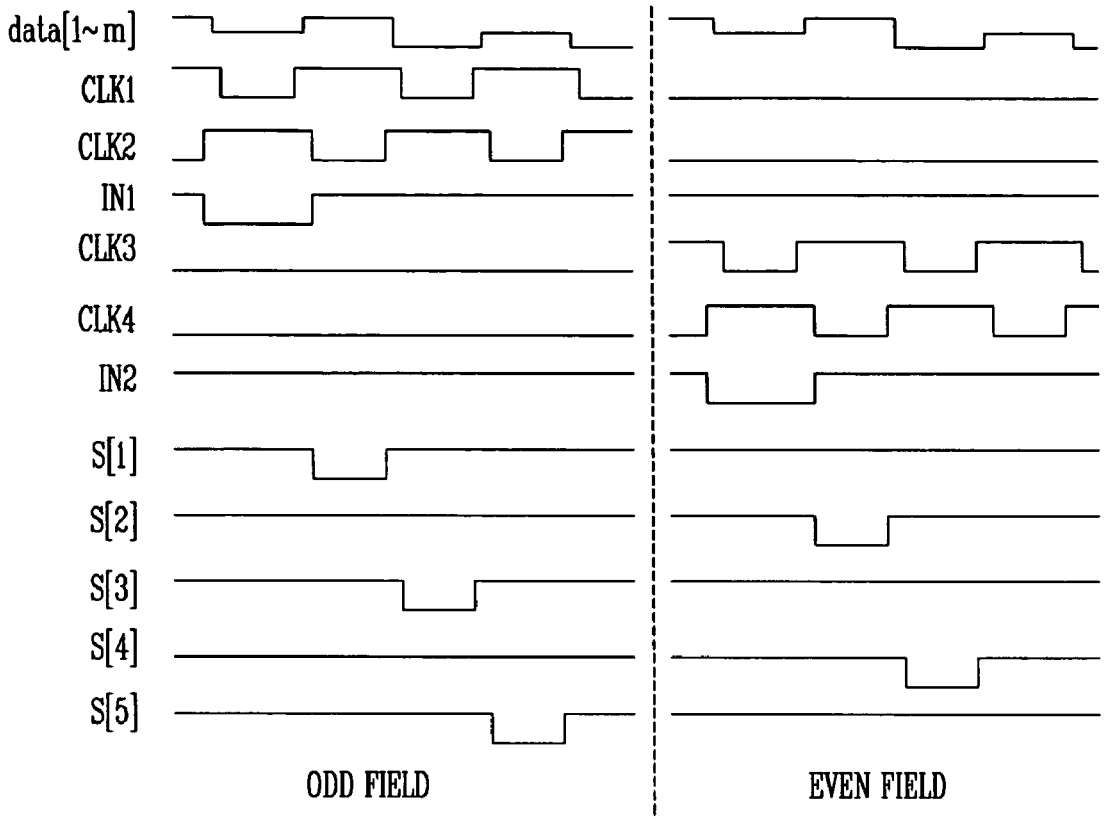
FIG. 10 illustrates a timing diagram of input/output signals of the stage in the scan driving circuit that is driven by the interlaced scanning method, according to an exemplary embodiment of the present invention.

FIG. 10 illustrates a timing diagram of input/output signals of the stage in the scan driving circuit by the interlaced scanning method, according to another exemplary embodiment of the present invention. Here, the stage has the same configuration as those illustrated in FIGS. 3 and 5, so repetitive descriptions thereof will not be discussed.

In the interlaced scanning method illustrated in FIG. 10, the third and fourth clock signals may have the low level in the odd field outputting the odd numbered scan signals, and the first and second clock signals are may have the low level in the even field outputting the even numbered scan signals, so that power consumption is reduced as compared with the interlaced scanning method illustrated in FIG. 9.

In the scan driving circuit with this configuration, the stages of the first scan driver and the second scan driver maintain the output terminals OUT thereof to be in the non-floating state during the first period A through the fourth period D as described above referring to FIGS. 3 and 4. Therefore, the scan signal is prevented from varying due to the coupling capacitance formed at the intersection between the scan lines and the data lines.

As discussed above, the present invention may provide a scan driving circuit and an organic light emitting display using the same, in which an output terminal of each stage in the scan driving circuit maintains a non-floating state regardless of whether the stage outputs a scan signal or not, thereby preventing the scan signal from varying due to coupling capacitance generated at the intersection of the scan lines and the data lines within a pixel portion.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A scan driving circuit, comprising:

an input terminal to receive an input signal or a voltage output from a previous stage;

a first clock terminal and a second clock terminal to receive first and second clock signals having phases inverted to each other and partially overlap at a high level, respectively; and a plurality of stages having output terminals to output scan signals having a low level in sequence, leaving an interval between the scan signals equivalent to a time the first and second clock signals overlap at the high level, wherein an output terminal of each stage is maintained to have a non-floating state regardless of whether the stage outputs the scan signal, and wherein each stage includes:

a first transistor receiving the voltage output from the previous stage or an initial input signal, and having a gate terminal connected to the first clock terminal, a second transistor having a gate terminal connected to an output terminal of the first transistor, the second transistor having input and output terminals connected to the second clock terminal and an output line, a third transistor having a gate terminal connected to the first clock terminal, the third transistor having an output connected to a first node and an input connected to a second power source or to the first clock terminal, a fourth transistor having a gate terminal connected to the output terminal of the first transistor, the fourth transistor having input and output terminals connected to the first clock terminal and the first node, and a fifth transistor having a gate terminal connected to the first node, the fifth transistor having input and output terminals connected to a first power source and the output line.

2. The scan driving circuit as claimed in claim 1, wherein the third transistor has input and output terminals connected to the second power source and the first node.

3. The scan driving circuit as claimed in claim 2, further comprising a first capacitor connected between the output terminal of the first transistor and the output line.

4. The scan driving circuit as claimed in claim 1, wherein for odd-numbered stages, each first clock terminal receives a first clock signal and each second clock terminal receives a second clock signal.

5. The scan driving circuit as claimed in claim 4, wherein pre-charge is performed while the first clock signal is at a low level and the second clock signal is at a high level, and evaluation is performed while the first clock signal is at the high level and the second clock signal is at the low level.

6. The scan driving circuit as claimed in claim 5, wherein a high level signal is output in the pre-charge period, and a signal having a level corresponding to the signal received in the pre-charge period is output in the evaluation period, and a previous output is maintained when the first and second clock signals are at the high level and the previous period is the pre-charge period, but a high level signal is output when the first and second clock signals are at the high level and the previous period is the evaluation period.

7. The scan driving circuit as claimed in claim 1, wherein for even-numbered stages, each first clock terminal receives a second clock signal and each second clock terminal receives a first clock signal.

8. The scan driving circuit as claimed in claim 6, wherein pre-charge is performed while the first clock signal is at a high level and the second clock signal is at a low level, and evaluation is performed while the first clock signal is at the low level and the second clock signal is at the high level.

9. The scan driving circuit as claimed in claim 7, wherein a high level signal is output in the pre-charge period, and a signal having a level corresponding to the signal received in the pre-charge period is output in the evaluation period, and a previous output is maintained when the first and second clock signals are at the high level and the previous period is the pre-charge period, but a high level signal is output when the first and second clock signals are at the high level and the previous period is the evaluation period.

10. The scan driving circuit as claimed in claim 1, wherein the third transistor has the gate terminal and the output terminal connected in common to the first clock terminal, and the input terminal connected to the first node.

11. The scan driving circuit as claimed in claim 10, further comprising a first capacitor connected between the output terminal of the first transistor and the output line.

12. A scan driving circuit having a plurality of stages connected to an input signal line or an output voltage line of a previous stage subordinately, and connected to two phase clock signal input lines, the scan driving circuit comprising:

a first scan driver receiving first and second clock signals and outputting odd numbered scan signals in sequence through the plurality of stages; and a second scan driver receiving third and fourth clock signals and outputting even numbered scan signals in sequence through the plurality of stages, wherein the output terminal of the stage is maintained to have a non-floating state regardless of whether the plurality of stages of the first and second scan drivers outputs the scan signal, and wherein each stage includes:

a first transistor receiving the voltage output from the previous stage or an initial input signal, and having a gate terminal connected to the first clock terminal, a second transistor having a gate terminal connected to an output terminal of the first transistor, the second transistor having input and output terminals connected to the second clock terminal and an output line, a third transistor having a gate terminal connected to the first clock terminal, the third transistor having an output connected to a first node and an input connected to a second power source or to the first clock terminal, a fourth transistor having a gate terminal connected to the output terminal of the first transistor, the fourth transistor having input and output terminals connected to the first clock terminal and the first node, and a fifth transistor having a gate terminal connected to the first node, the fifth transistor having input and output terminals connected to a first power source and the output line.

13. The scan driving circuit as claimed in claim 12, wherein the third transistor the input and output terminals connected to the second power source and the first node.

14. The scan driving circuit as claimed in claim 13, further comprising a first capacitor connected between the output terminal of the first transistor and the output line.

15. The scan driving circuit as claimed in claim 12, wherein the third transistor the gate terminal and the output terminal connected in common to the first clock terminal, and the input terminal connected to the first node.

16. The scan driving circuit as claimed in claim 15, further comprising a first capacitor connected between the output terminal of the first transistor and the output line.

17. The scan driving circuit as claimed in claim 12, wherein the odd numbered scan signal and the even numbered scan signal are alternately output in sequence from the first and second scan drivers.

18. The scan driving circuit as claimed in claim 17, wherein one of the third and fourth clock signals is at a low level while the first and second clock signals partially overlap at a high level.

19. The scan driving circuit as claimed in claim 12, wherein the first scan driver outputs a high level signal to the even numbered scan lines while outputting the odd numbered scan signals in sequence and the second scan driver outputs a high level signal to the odd numbered scan lines while outputting the even numbered scan signals in sequence.

20. The scan driving circuit as claimed in claim 19, wherein the third and fourth clock signals have the same waveform as the first and second clock signals.

21. The scan driving circuit as claimed in claim 19, wherein the third and fourth clock signals are output as the high level in an odd field to output the odd numbered scan signal, and the first and second clock signals are output as the high level in an even field to output the even numbered scan signal.

22. An organic light emitting display including a pixel portion having a plurality of pixels connected to scan lines and data lines; a data driving circuit to supply a data signal to the data lines; a scan driving circuit having a plurality of stages connected to an input signal line or an output voltage line of a previous stage subordinately, and connected to two phase clock signal input lines, the scan driving circuit comprising:

a first scan driver receiving first and second clock signals and outputting odd numbered scan signals in sequence through the plurality of stages; and a second scan driver receiving third and fourth clock signals and outputting even numbered scan signals in sequence through the plurality of stages, wherein the output terminal of the stage is maintained to have a non-floating state regardless of whether the plurality of stages of the first and second scan drivers outputs the scan signal, and wherein each stage includes:

a first transistor receiving the voltage output from the previous stage or an initial input signal, and having a gate terminal connected to the first clock terminal, a second transistor having a gate terminal connected to an output terminal of the first transistor, the second transistor having input and output terminals connected to the second clock terminal and an output line, a third transistor having a gate terminal connected to the first clock terminal, the third transistor having an output connected to a first node and an input connected to a second power source or to the first clock terminal, a fourth transistor having a gate terminal connected to the output terminal of the first transistor, the fourth transistor having input and output terminals connected to the first clock terminal and the first node, and a fifth transistor having a gate terminal connected to the first node, the fifth transistor having input and output terminals connected to a first power source and the output line.

* * * * *